US011641887B2

(12) United States Patent
D'Amato-Friedman

(10) Patent No.: US 11,641,887 B2
(45) Date of Patent: May 9, 2023

(54) BIB BOWL

(71) Applicant: Lisa Marie D'Amato-Friedman, Hollywood, CA (US)

(72) Inventor: Lisa Marie D'Amato-Friedman, Hollywood, CA (US)

( * ) Notice: Subject to any disclaimer, the term of this patent is extended or adjusted under 35 U.S.C. 154(b) by 0 days.

(21) Appl. No.: 16/099,340

(22) PCT Filed: May 9, 2017

(86) PCT No.: PCT/US2017/031822
§ 371 (c)(1),
(2) Date: Nov. 6, 2018

(87) PCT Pub. No.: WO2017/196893
PCT Pub. Date: Nov. 16, 2017

(65) Prior Publication Data

US 2019/0174838 A1 Jun. 13, 2019

Related U.S. Application Data

(60) Provisional application No. 62/334,246, filed on May 10, 2016.

(51) Int. Cl.
*A41B 13/10* (2006.01)

(52) U.S. Cl.
CPC ..... *A41B 13/103* (2013.01)

(58) Field of Classification Search
CPC ..... A41B 13/10; A41B 13/103
USPC ..... 2/49.1, 49.2
See application file for complete search history.

(56) References Cited

U.S. PATENT DOCUMENTS 453,490 A * 6/1891 Kropp ..... A41B 13/103 2/49.2
1,797,208 A * 3/1931 Weisz ..... A41D 13/04 2/51
2,389,596 A * 11/1945 Charnas ..... A45D 44/08 224/623
D216,291 S * 12/1969 Korshak ..... A41B 13/10 D2/864
4,660,226 A * 4/1987 Quilling ..... A41B 13/103 2/49.2
4,860,381 A * 8/1989 Bartley ..... A41B 13/103 2/49.3
4,924,527 A * 5/1990 Hintermeyer ..... A41B 13/103 2/46

(Continued)

OTHER PUBLICATIONS

"Modern-Twist Otter Waterproof Silicone Baby Bucket Bib with Adjustable Strap, Plastic Free, Wipe Clean and Dishwasher Safe, Red." Amazon, Aug. 2, 2013, www.amazon.com/modern-twist-Waterproof-Silicone-Adjustable-Dishwasher/dp/B0768JKRRF. (Year: 2013).*

(Continued)

*Primary Examiner* — Sally Haden
(74) *Attorney, Agent, or Firm* — Cislo & Thomas, LLP

(57) ABSTRACT

As disclosed herein, the present invention relates to a bib and bowl combination. In one embodiment, the present invention provides a bowl and bib operably linked as a single, flexible and collapsible piece that may be used by infants or elderly. In another embodiment, the bib and bowl combination is particularly well suited for mobile use such as while in a car seat, stroller, or walking.

4 Claims, 7 Drawing Sheets

(56) References Cited

U.S. PATENT DOCUMENTS 4,946,094 A * 8/1990 Stang ..... A41B 13/103 224/270
5,201,073 A * 4/1993 Spanier ..... A41B 13/103 2/247
5,244,278 A * 9/1993 Robitaille ..... A41B 13/103 15/227
5,483,701 A * 1/1996 Ferreyros ..... A41B 13/103 2/247
5,509,141 A * 4/1996 Saltzman ..... A41B 13/103 2/49.1
5,642,674 A * 7/1997 Joye, Sr. ..... A47B 23/002 108/25
5,878,672 A * 3/1999 Ostermann ..... B60N 3/004 108/44
6,105,165 A * 8/2000 Johnson ..... A41B 13/103 2/247
D448,143 S * 9/2001 Shealey ..... A41B 13/103 D2/860
6,581,210 B2 * 6/2003 Kaloustian ..... A41B 13/106 2/49.1
D491,342 S * 6/2004 Jordan ..... D2/861
7,143,448 B1 * 12/2006 Gottehrer ..... A41B 13/103 2/49.2
7,269,857 B2 * 9/2007 Cymbol ..... A41B 13/103 2/49.1
D811,700 S * 3/2018 D'Amato-Friedman ..... A41B 13/103 D2/864
11,064,742 B2 * 7/2021 Amrikhas ..... A41B 13/103
11,089,823 B2 * 8/2021 Chuah ..... A41B 13/103
2007/0061939 A1 * 3/2007 Rose ..... A41B 13/10 2/49.1
2007/0143904 A1 * 6/2007 Brown ..... A41B 13/103 2/49.1
2007/0157357 A1 * 7/2007 Cymbol ..... A41B 13/103 2/49.2
2007/0250979 A1 * 11/2007 Han ..... A41B 13/103 2/49.1
2009/0152161 A1 * 6/2009 St. Cyr ..... A45C 11/00 206/581
2011/0067161 A1 * 3/2011 Perazzo ..... A41B 13/103 2/49.3
2013/0291276 A1 * 11/2013 Monahon ..... A41B 13/04 2/49.2
2014/0059733 A1 * 3/2014 Kassis ..... A41B 13/103 2/49.2
2014/0173800 A1 * 6/2014 Wulf ..... A41B 13/106 2/49.3
2015/0173434 A1 * 6/2015 Sabre ..... A41B 13/10 2/48
2017/0303602 A1 * 10/2017 Petersen ..... A47G 19/08
2018/0220715 A1 * 8/2018 Bisson ..... A41B 13/103
2019/0099010 A1 * 4/2019 Tollett ..... A47D 3/00
2019/0133204 A1 * 5/2019 Martone Cardinale ..... A41B 13/103
2019/0223518 A1 * 7/2019 Schutte ..... A41B 13/10

OTHER PUBLICATIONS

"Amazon Silicone Bib." Google Search, Google, www.google.com/. (Year: 2019).*
Kintner, Kelcey. "Best Bibs & Smocks for Feeding Babies and Toddlers."Alpha Mom, Alpha Mom, Mar. 5, 2014, https://alphamom.com/parenting/baby/best-bibs-smocks-for-feeding-babies-and-toddlers/. (Year: 2014).*

* cited by examiner

BIB BOWL

CROSS REFERENCE TO RELATED APPLICATIONS

This application is a National Phase of International Application No. PCT/US2017/031822, filed May 09, 2017, which designated the U.S. and that International Application was published under PCT Article 21(2) in English. This application also includes a claim of priority under 35 U.S.C. §119(e) to U.S. Provisional Application No. 62/334,246, filed May 10, 2016, the entirety of which is hereby incorporated by reference.

FIELD OF THE INVENTION

The present invention is related to the field of tray and bib systems.

BACKGROUND OF THE DISCLOSURE

While bibs and eating trays for infants and elderly are both available, there remains a need for an effective system that combines the use of both a bib and a tray in such a way that allows greater convenience for the user's caregiver, such as a mother, or guardian, while still maintaining safety for the user, such as an infant, than what is otherwise commercially available. For example, while bibs may shield an infant from mess during eating, the same bib may not be effective for use while in a moving car or in a baby carriage, either because it doesn't effectively shield the infant from mess or because it requires an additional tray component for mobile use. Or, for example, a tray and bib combination may be unsuitable and unsafe for use by an infant or elderly, due to components with sharp or metal edges, for example, especially if used in a mobile setting.

Thus, there is a need in the art for novel and effective bib and tray combination systems for infants and elderly.

SUMMARY OF THE DISCLOSURE

Various embodiments include a bowl and bib combination for use during feeding of a user, comprising a bowl and a bib operably and physically linked together as a single, flexible and collapsible piece. In another embodiment, the bowl and the bib are positioned in a perpendicular fashion to each other. In another embodiment, the single, flexible and collapsible piece is made of silicone. In another embodiment, the bib is adapted for use by an elderly user. In another embodiment, the bib is adapted for use by an infant user. In another embodiment, the bowl is adapted for use by an elderly user. In another embodiment, the bowl is adapted for use by an infant user. In another embodiment, the single, flexible and collapsible piece is dishwasher safe. In another embodiment, the single, flexible and collapsible piece is BPA free. In another embodiment, the single, flexible and collapsible piece is lightweight. In another embodiment, the bowl contains two compartments. In another embodiment, the bowl contains three or more compartments. In another embodiment, the compartments are adapted for carrying food for an infant or child. In another embodiment, the bowl further comprises an air tight lid. In another embodiment, the bib further comprises a slit for carrying utensils and/or accessories. In another embodiment, the bib contains a silicone adjustable button for sizing and security by the user. In another embodiment, the bowl and bib combination is described as FIGS. 1-6 herein.

Other embodiments include a bowl and bib combination for mobile feeding by an infant user, comprising a bowl and a bib operably linked as a single, flexible and collapsible piece, wherein the bib is angled in a downward fashion to stabilize the bowl on a table for the infant user. In another embodiment, the bowl and bib combination is adapted for use in a car seat. In another embodiment, the bowl and bib combination is adapted for use in a stroller.

Other embodiments include a method of mobile feeding for an individual, comprising providing a bowl and bib combination, comprising a bowl and a bib operably linked as a single, flexible and collapsible piece, and feeding the individual. In another embodiment, the individual is an infant. In another embodiment, the individual is an adult. In another embodiment, the individual is elderly.

Various embodiments include a portable device, comprising a bowl to carry food by the user, a bib comprising a sufficient amount of surface area to fully protect a user from dropped food, and a lid for sealing the contents of the bowl, wherein the portable device is in its entirety a single, flexible and collapsible piece. In another embodiment, the material is a dishwasher safe material. In another embodiment, the user is an infant. In another embodiment, the bowl contains one or more dividers.

Other features and advantages of the invention will become apparent from the following detailed description, taken in conjunction with the accompanying drawings, which illustrate, by way of example, various embodiments of the invention.

DESCRIPTION OF THE DRAWINGS

Exemplary embodiments are illustrated in referenced figures. It is intended that the embodiments and figures disclosed herein are to be considered illustrative, rather than restrictive.

FIG. 3 illustrates, in accordance with embodiments herein, an example of a bib 100 and bowl 101 combination, further includes a slit 106 to hold utensils, such as a fork and spoon.

DETAILED DESCRIPTION

All references, publications, and patents cited herein are incorporated by reference in their entirety as though they are fully set forth. Unless defined otherwise, technical and scientific terms used herein have the same meaning as commonly understood by one of ordinary skill in the art to which this invention belongs. One skilled in the art will recognize many methods and materials similar or equivalent to those described herein, which could be used in the practice of the present invention. Indeed, the present invention is in no way limited to the methods and materials described.

As used herein, the term "infant" also includes newborns, toddlers and young children.

Figure 1:
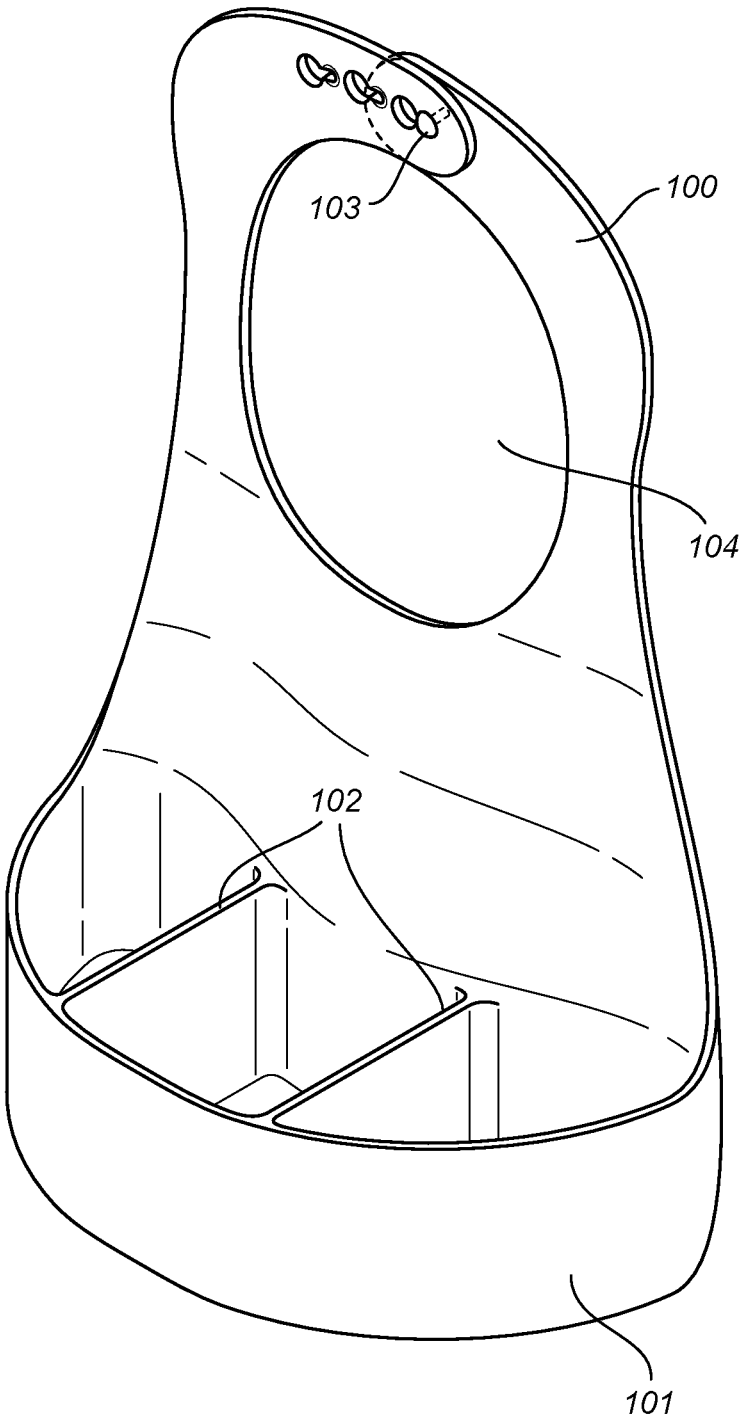
FIG. 1 illustrates, in accordance with embodiments herein, an example of a bib 100 and bowl 101 combination, where the bib 100 is in a closed position, and the bib is non-adjustably connected to the bowl.
Figure 2:
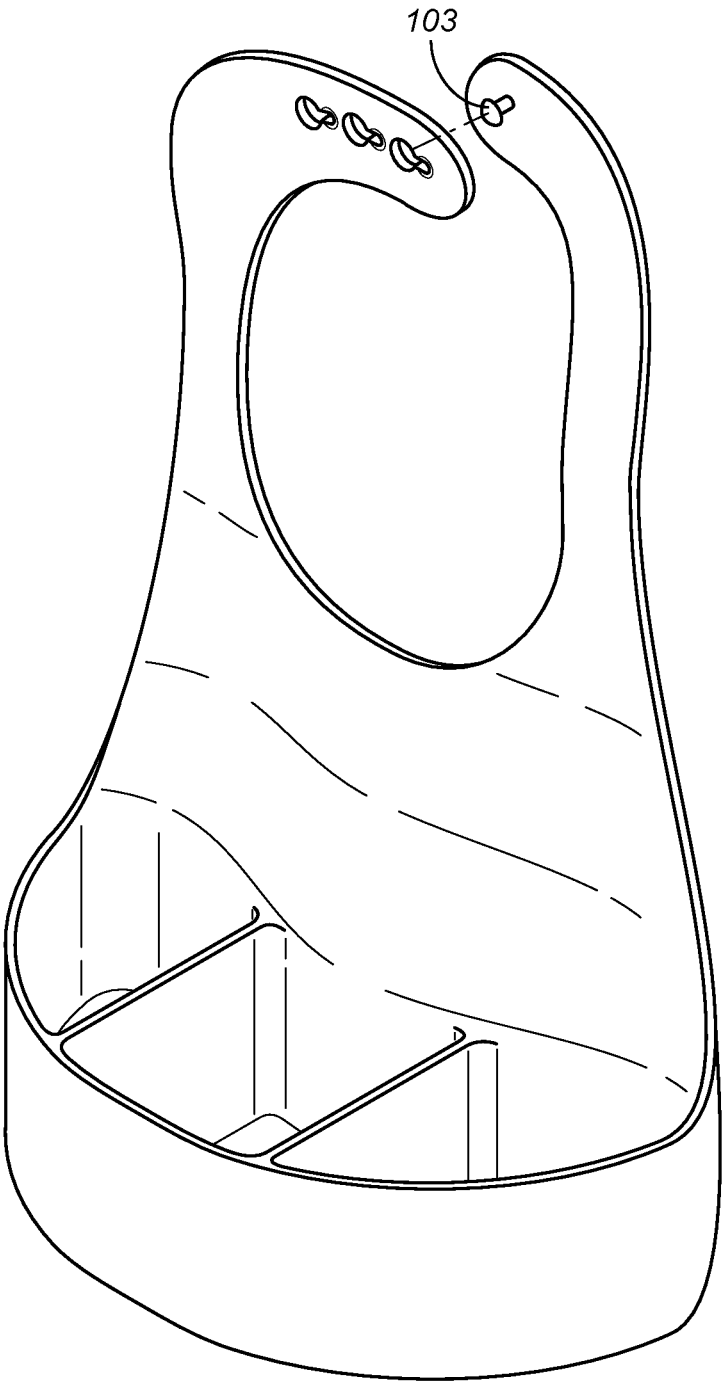
FIG. 2 illustrates, in accordance with embodiments herein, an example of a bib 100 and bowl 101 combination, where the bib 100 is in a unclosed position.
Figure 3A:
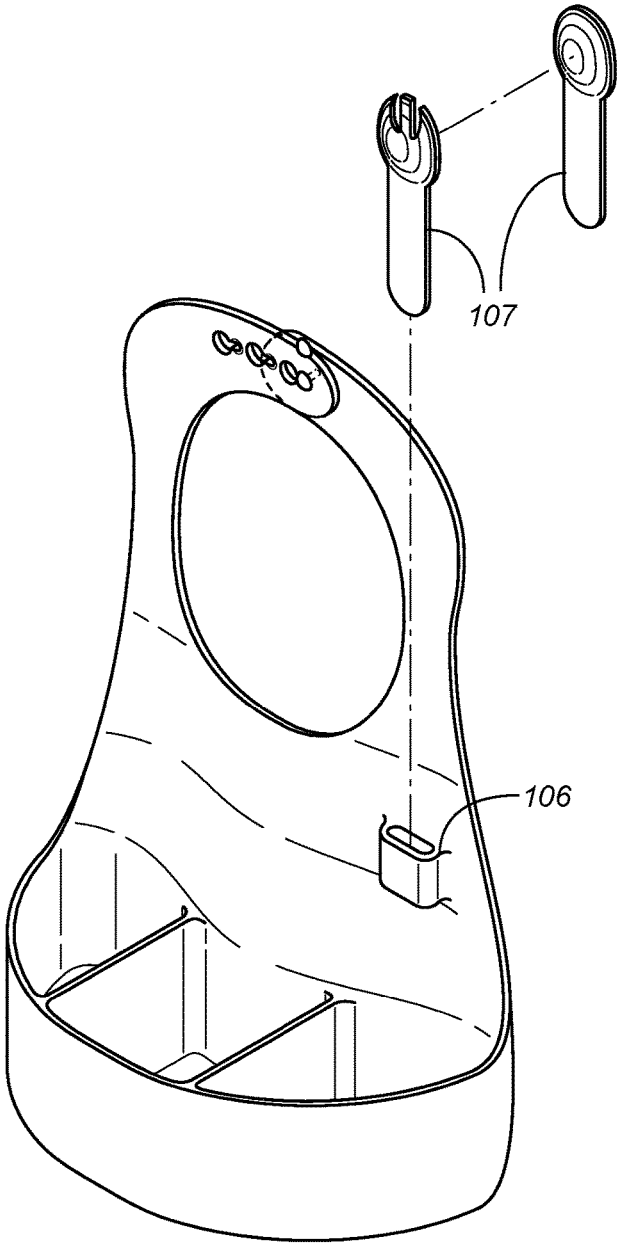
FIG. 3A illustrates the open slit.
Figure 3B:
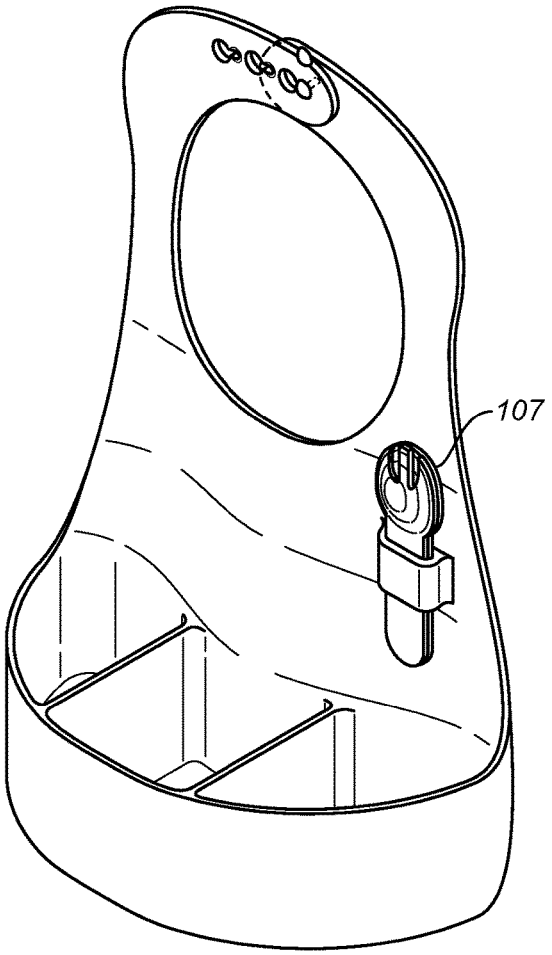
FIG. 3B illustrates the closed slit 106, with both fork and spoon fitting in unison into a single slit of the bib 100.
Figure 4:
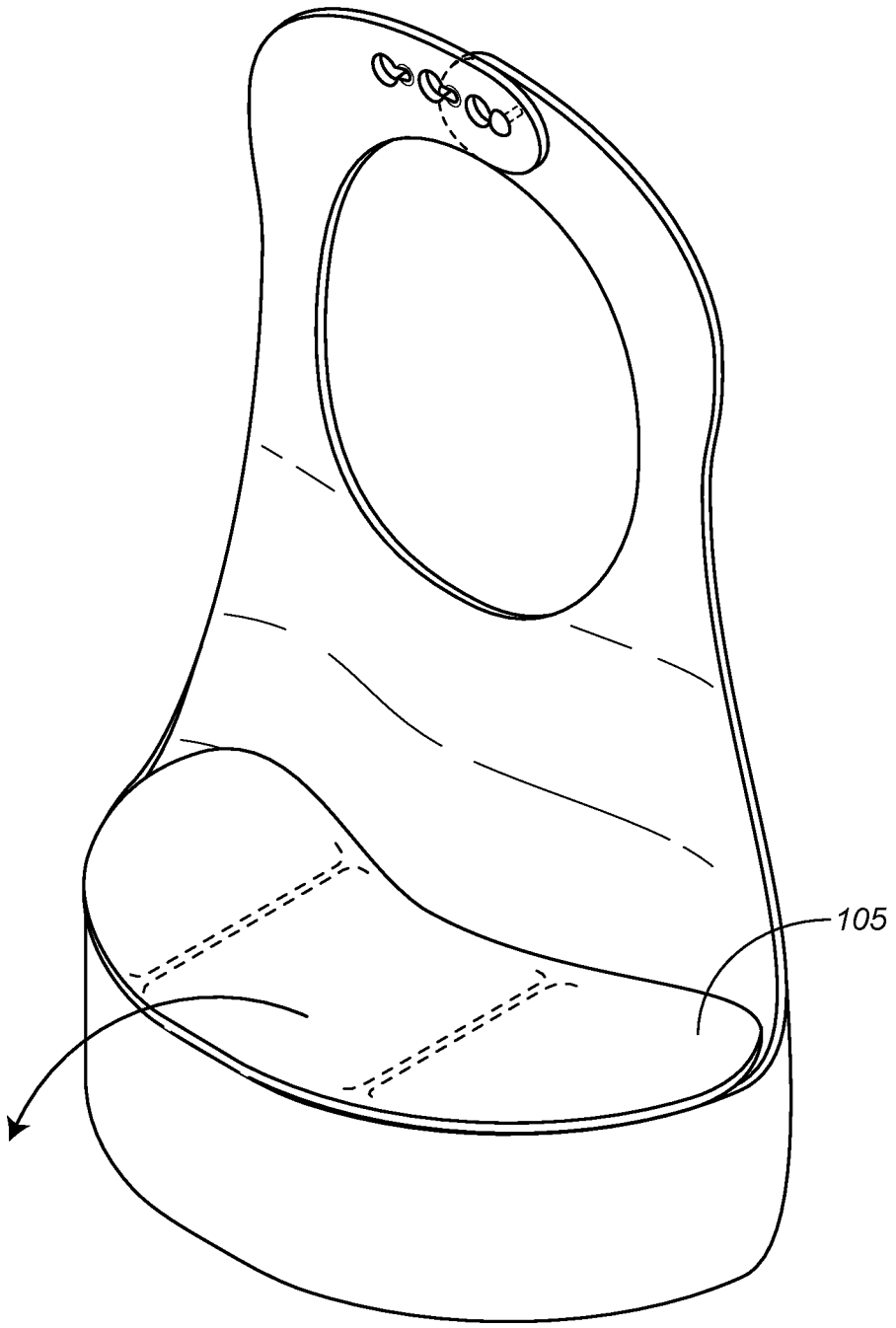
FIG. 4 illustrates, in accordance with embodiments herein, an example of a bib 100 and bowl 101 combination, further including a lid 105 for the bowl 101. In accordance with embodiments herein, when closed, the lid 105 may create an air-tight seal.
Figure 5:
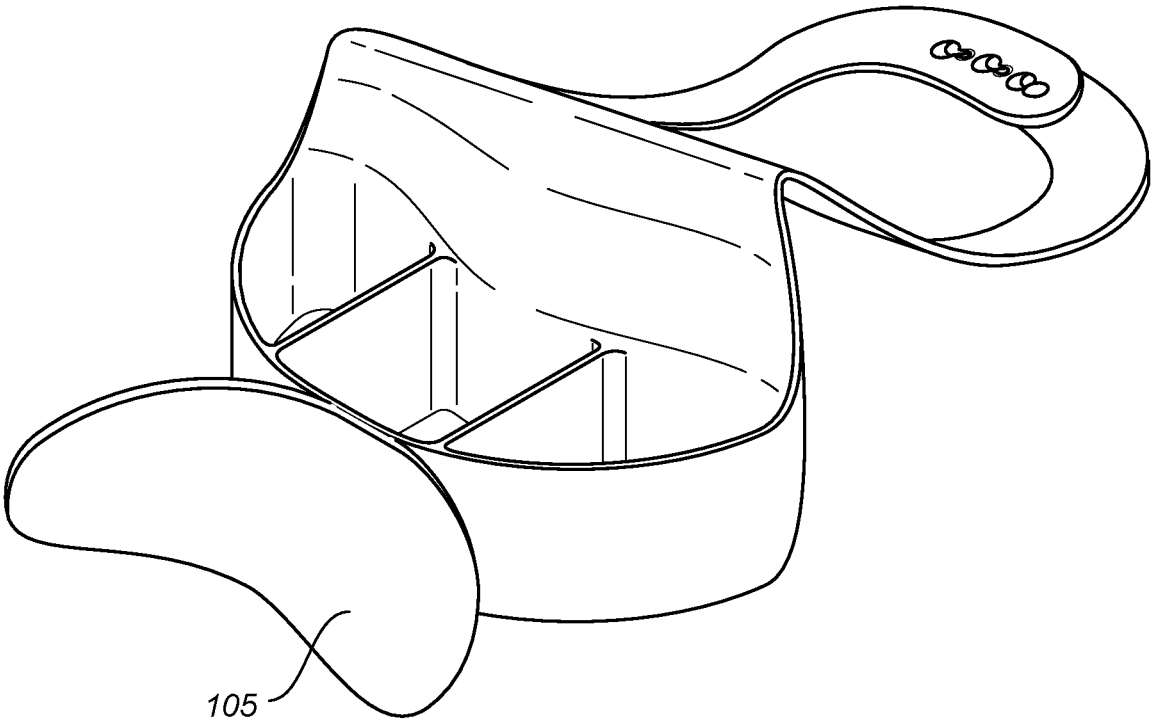
FIG. 5 illustrates, in accordance with embodiments herein, an example of a bib 100 and bowl 101 combination, showing the lid 105 in an open position.
Figure 6:
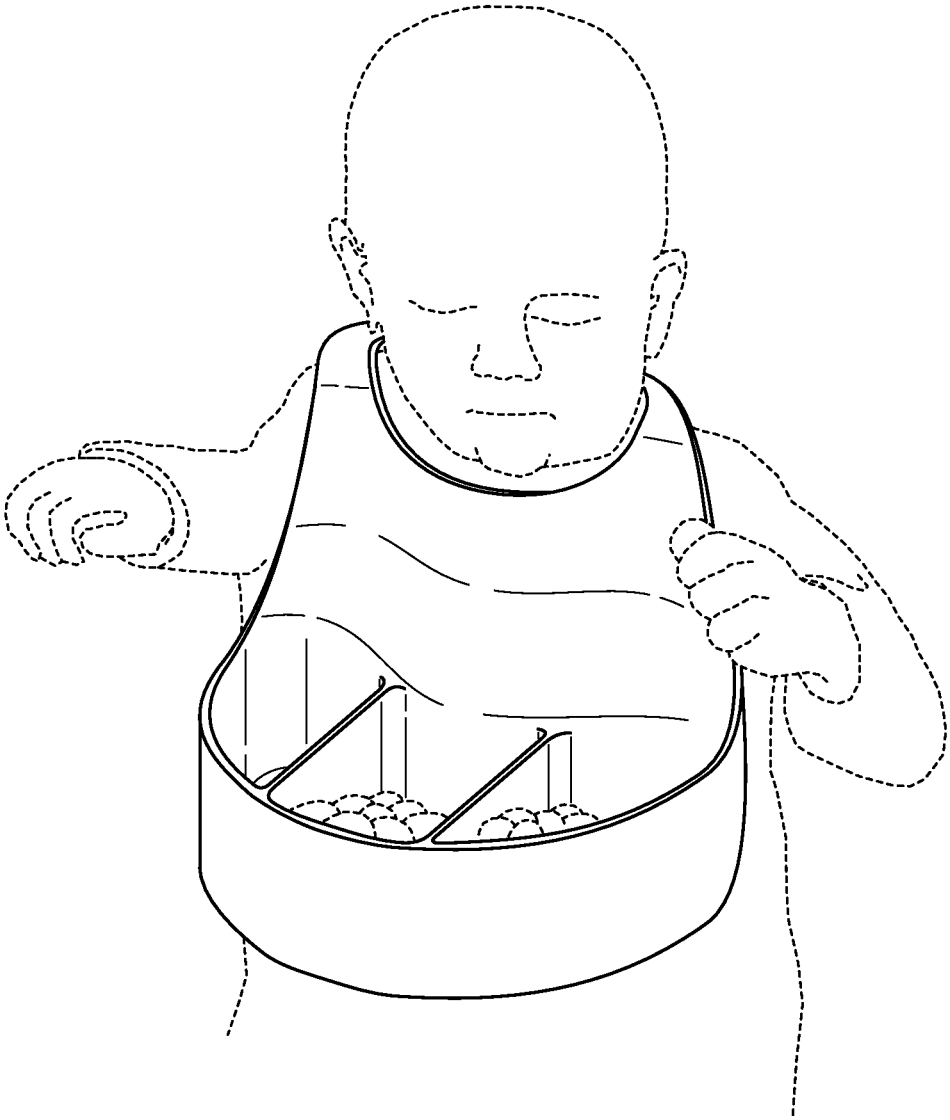
FIG. 6 illustrates, in accordance with embodiments herein, an example of a bib 100 and bowl 101 combination as used by an infant.
Figure 7:
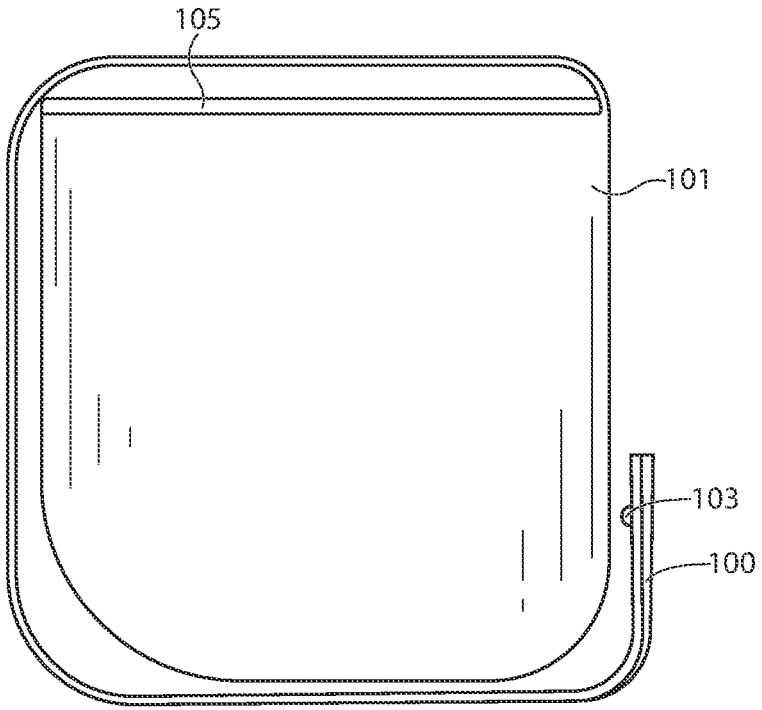
FIG. 7 illustrates, in accordance with embodiments herein, an example of a bib 100 and bowl 101 combination shown from the side with the bowl 101 rolled up into the bib 100.

As disclosed herein, the inventor designed various bib 100 and bowl 101 combinations, such as a silicone bib 100 that is also a bowl 101 all-in-one for babies and toddlers, or in a larger size, for elders that may have difficulty eating while sitting up. FIGS. 1-6 herein provide illustrative examples of the bib 100 and bowl 101 combination. The bib 100 and bowl 101 combination was created from the inventor's own need as a new mother and inability to find anything suitable on the market for her baby. Like other mothers, the inventor wanted something practical and suited for an often times "on the go" and hectic schedule. In accordance with embodiments herein, the bib 100 and bowl 101 combination is made as a single piece/ molding, is simple to use, easy to handle, light weight, and can be made relatively inexpensively. In accordance with embodiments herein, the bib 100 and bowl 101 combination catches spills effectively while also including a bowl 101, all in one single piece. In accordance with embodiments herein, the combination also includes 2 simple dividers 102 within the bowl for the convenience of having 3 food groups all at once for a more nutritious meal and without them getting mixed together. As a result, the bib 100 and bowl 101 combination allows a parent to save time and energy by feeding their child full meals on the go while they sit in their car seat, or stroller, or even walking. After they are finished, the parent can throw any food remains in any type of trash can where ever you are and easily just grab a wet wipe and wipe it clean and dispose of at the on-the-go location. Then the parent could just roll up and throw back into their diaper bag the bib 100 and bowl 101 combination and wash later or even wash at their convince in a bathroom nearby during the next diaper change.

In one embodiment, the present invention provides a bowl and bib combination comprising a bowl 101 and bib 100 operably linked as a single, flexible and collapsible piece. In another embodiment, the present invention provides a bib 100 that is a bowl 101 all-in-one for babies and toddlers. In another embodiment, the bib 100 is a large size adapted for use of elders in hospital beds, and/or individuals who have difficulty eating sitting completely up. In another embodiment, the bowl 101 and bib 100 combination is made of silicone. In another embodiment, the bowl 101 and bib 100 combination is dishwasher safe and/or BPA Free. In another embodiment, the bowl 101 and bib 100 combination provides a single and light weight piece that is particularly suited for mobile use. In another embodiment, the bib 100 contains an adjustable button 103. In another embodiment, the adjustable button 103 goes to a squared point. In another embodiment, mobile use includes feeding an infant meals on the go while they sit in their car seat, stroller, and/or walking. In another embodiment, the bowl 101 of the bowl 101 and bib 100 combination includes one or more dividers 102. In another embodiment, the bowl 101 includes two or more dividers 102. In another embodiment, the bowl 101 includes two dividers 102 for the convenience of having three different food groups all at once for a more nutritious meal and without mixing the food groups. In another embodiment, the bowl 101 and bib 100 combination is adapted for easy cleaning. For example, after use by an infant, the parent may throw any food remains in the trash, use a wet wipe to clean and dispose of any subsequent mess at the location, and then roll up the bowl 101 and bib 100 combination and place it into a diaper bag for washing later, such as in a bathroom nearby during the next diaper change. In another embodiment, the space 104 between eating and bowl 101 of the bib 100 and bowl 101 combination is only 4 to 5 inches, which is covered by silicone material. In another embodiment, the bowl 101 further includes a lid 105. In another embodiment, the closed lid 105 provides an air tight seal with the bowl 101. In another embodiment, the bib 100 and bowl 101 combination contains a decorative design and/or print. In another embodiment, the bib 100 of the bib 100 and bowl 101 combination further contains a slit 106 for carrying additional utensils or accessories 107. In another embodiment, the slit 106 contains a fork and/or spoon that fits in unison into the slit.

Further, in accordance with embodiments herein, the neck section of the bib 100 could be angled and then used as a leveling device, so that a child or infant user may eat from the bib 100 and bowl 101 combination while facing the bib 100 and bowl 101 combination, such as one would conventionally eat from a stable bowl for any table.

As an example, in one embodiment, the present invention provides a bib 100 and bowl 101 combination with a neck space, of 8¼ inches in length, and/or 10½ to 12 inches in diameter. In another embodiment, the space is 5 to 8 inches in length. In another embodiment, the space is 8 to 12 inches in length. In another embodiment, the space is 12 to 18 inches in length. In another embodiment, the space is 15 to 20 inches in length. In another embodiment, the present invention provides a bib 100 and bowl 101 combination with a total vertical length of 12 inches. In another embodiment, the total vertical length is 5 to 10 inches. In another embodiment, the total vertical length is 10 to 20 inches. In another embodiment, the total vertical length is 20 to 30 inches. In another embodiment, the present invention provides a bib 100 and bowl 101 combination includes one or more adjustable buttons 103 that go to a squared point. In another embodiment, the one or more adjustable buttons 103 are ¾ inches in length. In another embodiment, the one or more adjustable buttons 103 are ½ inch to 1 inch in length. In another embodiment, the present invention provides a bib 100 and bowl 101 combination that includes an additional gap for the adjustable button 103 to be inserted for security purposes. In another embodiment, the additional gap is a ½ inch gap. In another embodiment, there are 3 size options. In another embodiment, there are 1 to 5 size options. In another embodiment, the adjustable button 103 is silicone. In another embodiment, there is 3¾ inches between the bottom of the neck space 104 and the bowl 101. In another embodiment, there is between 2 and 8 inches between the bottom of the neck space 104 and the bowl 101. In another embodiment, the present invention provides a bib 100 and bowl 101 combination with a plurality of dividers 102, wherein the dividers 102 are separated by 3 inches. In another embodiment, the plurality of dividers 102 are separated by between 1 and 4 inches. In another embodiment, the bib 100 and bowl 101 combination includes three dividers 102, wherein the middle divider 102 has a width of 3½ inches between inner and outer bowl 101, and each of the two outside dividers 102 has a width of 2½ inches between inner and outer bowl 101. In another embodiment, the divider 102 is silicone.

Embodiments of the present disclosure are further described in the following examples. The examples are merely illustrative and do not in any way limit the scope of the invention as claimed.

EXAMPLES

Example

Some Advantages

The bib and bowl combination is a silicone bib that is also a bowl all-in-one for babies and toddlers. Or, for larger sizes, for the help of elders in hospital beds or any other need for them since they have trouble eating sitting completely up. The bib and bowl combination is dishwasher safe as well as BPA Free. The bib and bowl combination was initially designed from the inventor's own idea as a new mother and wanting something on the market like this for her baby since she's always on the go and always have a very hectic schedule so, like herself, caters to busy parents on the go. Since it is made as one single piece/molding, it is simple to use, easy to handle, light weight, and very inexpensive as well since it isn't made from any type of expensive material.

Instead of using a bib for just "catching spills" and "protecting kids clothes", the bib and bowl combination is not only 100% more effective in these cases from any bib on the market today but it also provides the actual bowl all-in-one. It includes 2 simple dividers within the bowl for the convenience of having 3 food groups all at once for a more nutritious meal and without them getting mixed together.

With the bib and bowl combination, one can save a ton of time and energy by feeding your child full meals on the go while they sit in their car seat, or stroller, or even walking. After they are finished, any food remains can be thrown way in any type of trash can wherever they are and easily just grab a wet wipe and wipe it clean and dispose of at their on-the-go location. Then one could just roll up and throw back into their diaper bag and wash later or even wash at their convince in a bathroom nearby during the next diaper change, for example.

The bib and bowl combination is much more efficient in catching spills than any other bib on the market because it eliminates any space between any plate, or bowl, or table, or counter, or even a stroller bar which is always used to place snacks for kids when on the go. Spills still happen. They always still happen because that space is large. With the bib and bowl combination, the space is completely eliminated to just about 4-5" which is completely covered by the silicone material and even if spills happen in that space, gravity pulls it right down to be caught in the bowl of the bib itself.

From a practical standpoint, parents are exhausted. Parents may not have time to watch a child eat for an hour at a table, or being on a car trip and having to pull over to feed their child. Then having dirty Tupperware, if the parent packed healthy meals for their child, which is bulky, wasting valuable time just sitting there waiting for your kid to finish eating which most of the time they end up playing with their food, or even being so busy that while on the go, their child gets hungry but need to grab something quick and less nutritious because it's less messy but can end up giving their child a stomachache or long-term effect of just being a less healthy kid over all. As a busy, tired parent the bib and bowl combination makes life so much easier and less messy and most importantly the option to eat messy and more balanced meals because it's 2 things in one with much more security when it comes to spills.

The various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as may be taught or suggested herein. A variety of advantageous and disadvantageous alternatives are mentioned herein. It is to be understood that some preferred embodiments specifically include one, another, or several advantageous features, while others specifically exclude one, another, or several disadvantageous features, while still others specifically mitigate a present disadvantageous feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be mixed and matched by one of ordinary skill in this art to perform methods in accordance with principles described herein. Among the various elements, features, and steps some will be specifically included and others specifically excluded in diverse embodiments.

Although the invention has been disclosed in the context of certain embodiments and examples, it will be understood by those skilled in the art that the embodiments of the invention extend beyond the specifically disclosed embodiments to other alternative embodiments and/or uses and modifications and equivalents thereof.

Many variations and alternative elements have been disclosed in embodiments of the present invention. Still further variations and alternate elements will be apparent to one of skill in the art. Various embodiments of the invention can specifically include or exclude any of these variations or elements.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

In some embodiments, the terms "a," "an," and "the" and similar references used in the context of describing a particular embodiment of the invention (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified.

Preferred embodiments of this invention are described herein, including the best mode known to the inventors for carrying out the invention. Variations on those preferred embodiments will become apparent to those of ordinary skill in the art upon reading the foregoing description. It is contemplated that skilled artisans can employ such variations as appropriate, and the invention can be practiced otherwise than specifically described herein. Accordingly, many embodiments of this invention include all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents and printed publications throughout this specification. Each of the above cited references and printed publications are herein individually incorporated by reference in their entirety.

In closing, it is to be understood that the embodiments of the invention disclosed herein are illustrative of the principles of the present invention. Other modifications that can be employed can be within the scope of the invention. Thus, by way of example, but not of limitation, alternative configurations of the present invention can be utilized in accordance with the teachings herein. Accordingly, embodiments of the present invention are not limited to that precisely as shown and described.

What is claimed is:

1. A method of mobile feeding for an individual, comprising: providing a bowl and bib combination, comprising a bowl with multiple compartments and a bib operably linked as a single, flexible and collapsible piece; removing a utensil from a slit formed on the bib; feeding the individual with the utensil; and when finished feeding, sealing the bowl with a lid; and rolling the bowl into the bib, wherein the bowl comprises a back, a front opposite the back, a first side adjacent to the back and the front, a second side opposite the first side and adjacent to the back and the front, a bottom adjacent to the back, the front, the first side, and the second side, a top opposite the bottom and adjacent to the front, the back, the first side, and the second side, and dividers in between the first side and the second side, the dividers extending from the back towards the front of the bowl to define the multiple compartments, wherein the dividers have a divider width as measured from the front of the bowl to the back of the bowl ranging from 2.5 inches to 3.5 inches, and a height extending from the bottom of the bowl substantially to the top, wherein the bib comprises a neck section defining an opening, wherein a bottom of the neck section to the bowl measures 3.75 inches to 8 inches wherein the bib comprises silicone, wherein the bowl has a bowl width defined by a distance from the first side to the second side, wherein the bib below the opening defines a bib width, wherein the bowl width extends substantially a distance of the bib width.

2. The method of claim 1, wherein the individual is an infant.

3. The method of claim 1, wherein the individual is an adult.

4. The method of claim 1, wherein the individual is elderly.

* * * * *